US010460888B1

(12) United States Patent
Zeitler

(10) Patent No.: US 10,460,888 B1
(45) Date of Patent: Oct. 29, 2019

(54) DEFEATER ASSEMBLY

(71) Applicant: Ron Zeitler, Saginaw, MI (US)

(72) Inventor: Ron Zeitler, Saginaw, MI (US)

( * ) Notice: Subject to any disclaimer, the term of this patent is extended or adjusted under 35 U.S.C. 154(b) by 0 days.

(21) Appl. No.: 16/102,913

(22) Filed: Aug. 14, 2018

(51) Int. Cl.
*H01H 9/22* (2006.01)
*H01H 3/20* (2006.01)

(52) U.S. Cl.
CPC ..... *H01H 9/223* (2013.01); *H01H 3/20* (2013.01)

(58) Field of Classification Search
CPC ..... H01H 9/223; H01H 9/22; H01H 3/20; H01H 9/20; H01H 9/285; H01H 9/28; H01H 9/26; H01H 9/281–287; H01H 9/287; H01H 9/24; H01H 2300/018; H01H 71/56; H01H 13/14; H01H 71/0264; H01H 9/06; H01H 19/14; H01H 71/128; H01H 71/505; H01H 9/282; H01H 9/286; H01H 3/38; H01H 3/46; H01H 71/521
USPC ..... 200/50.02, 50.12, 330, 50.01, 50.03, 200/50.18, 322, 401, 48 R, 50.21, 50.26
See application file for complete search history.

(56) References Cited

U.S. PATENT DOCUMENTS

| | | | | |
|---|---|---|---|---|
| 4,031,340 | A | 6/1977 | Pastorel | |
| 5,700,985 | A * | 12/1997 | Fischer | H01H 9/282 200/50.01 |
| 5,944,397 | A * | 8/1999 | Zeitler | E05B 65/0003 312/217 |
| 5,963,420 | A * | 10/1999 | Bailey | H01H 9/223 200/50.02 |
| 6,284,989 | B1 * | 9/2001 | Bernier | H01H 9/223 200/50.12 |
| 6,506,986 | B2 | 1/2003 | Bernier et al. | |
| 6,943,999 | B2 * | 9/2005 | Gray | H02B 11/133 361/1 |
| 7,405,369 | B2 * | 7/2008 | Mukharzi | H01H 9/223 200/50.01 |

* cited by examiner

*Primary Examiner* — Ahmed M Saeed

(57) ABSTRACT

This invention deals with a cable operated mechanical defeater. The purpose of the device is to add an additional level of safety that requires the primary door latch or handle to close and engage before the electrical disconnect is turned on.

1 Claim, 3 Drawing Sheets

DEFEATER ASSEMBLY

BACKGROUND OF THE INVENTION

This invention deals with a cable operated mechanical defeater. The purpose of the device is to add an additional level of safety that requires the primary door latch or handle to close and engage before the electrical disconnect is turned on.

The inventor herein is aware of two U.S. patents that deal with defeater mechanisms. In U.S. Pat. No. 4,031,340, that issued Jun. 21, 1977 to Pastorel, there is disclosed a defeater for mechanical safety interlock for covers of explosion-proof electrical housing. The device consists of an explosion-proof electrical enclosure that has a body switch mounted within the body, two threaded caps cooperatively engaging manually defeatable locking bolts in the body which prevent rotation of the caps and manually operated interlocking mechanism mounted in the body to actuate a switch and prevent unlocking of the bolts in the switch-on position.

In U.S. Pat. No. 6,506,986, that issued Jan. 14, 2003 to Bernier, et. al., there is disclosed an alternate door interlock defeater. The device includes a support platform having an operator handle stem operably connected to the circuit breaker, an interlock slide plate slidably positioned along the support platform and having a key-shaped slot for receiving a door interlock pin, a lever operably connected to the interlock slide plate and configured to defeat the interlock mechanism when the door interlock pin is engaged with the slot. Neither of these references disclose the novel invention set forth herein.

THE INVENTION

Thus, what is disclosed herein is a cable operated mechanical defeater. The cable operated mechanical defeater comprises in combination a rod assembly, wherein the rod assembly comprises a first rod guide. The rod guide comprises a flat plate having a first edge. The first edge contains a top perpendicular tab with a centered opening, a middle perpendicular tab with a centered opening, and a bottom perpendicular tab with a centered opening.

There is a top rod, the top rod comprising a first L-shape, with the foot of the first L-shape perpendicular to the flat plate. The top rod has a top end and a bottom end.

There is a top extension spring; the top extension spring is attached by a first end to the top of the top rod, the opposite end of the top extension spring is releasably attached to the top perpendicular tab.

There is a bottom extension spring, the bottom extension spring is attached to the bottom of the top rod by a first end and the bottom extension spring is attached to a cable at the second end. The opposite end of the cable is attached to a top arm of a cam lever assembly.

The cam lever assembly comprises a base mounting bracket comprising a second L-shaped flat plate having a first edge and a second edge. The first edge has two openings through it for insertion of machine screws and the second edge has a middle slot in it.

There is an adjustable mounting bracket comprising a flat plate, the flat plate is mounted rotatably on a post projecting perpendicular from the flat plate. The mounting bracket has a top edge and a bottom edge, a first side edge and a second side edge. The adjustable mounting bracket has two perpendicular tabs at the first side edge, and at least two slotted openings in the second side edge, a stop plate centered in the flat plate, and a mounting post projecting perpendicular to the adjustable mounting bracket, near the second side edge.

Rotatably mounted on the mounting post is a cam lever. The cam lever has a first end and a second end, there being a pivot arm rotatably mounted on the second end, the first end having a defeater striker integrally mounted on it.

There is an adjustable hook. The adjustable hook has an adjustable hook mounting bracket, the adjustable mounting bracket being a second L-shaped flat plate having a first panel and a second panel. The first panel has at least two separated, elongated slots near a top edge and near a bottom edge, and the adjustable mounting bracket has an elongated slot near an edge of the second panel.

There is a disconnect hook, the disconnect hook is mounted on the L of the second L-shaped plate. There is a defeater, said defeater attachable to a latch of a disconnect operating handle.

DETAILED DESCRIPTION OF THE DRAWINGS

Figure 1:
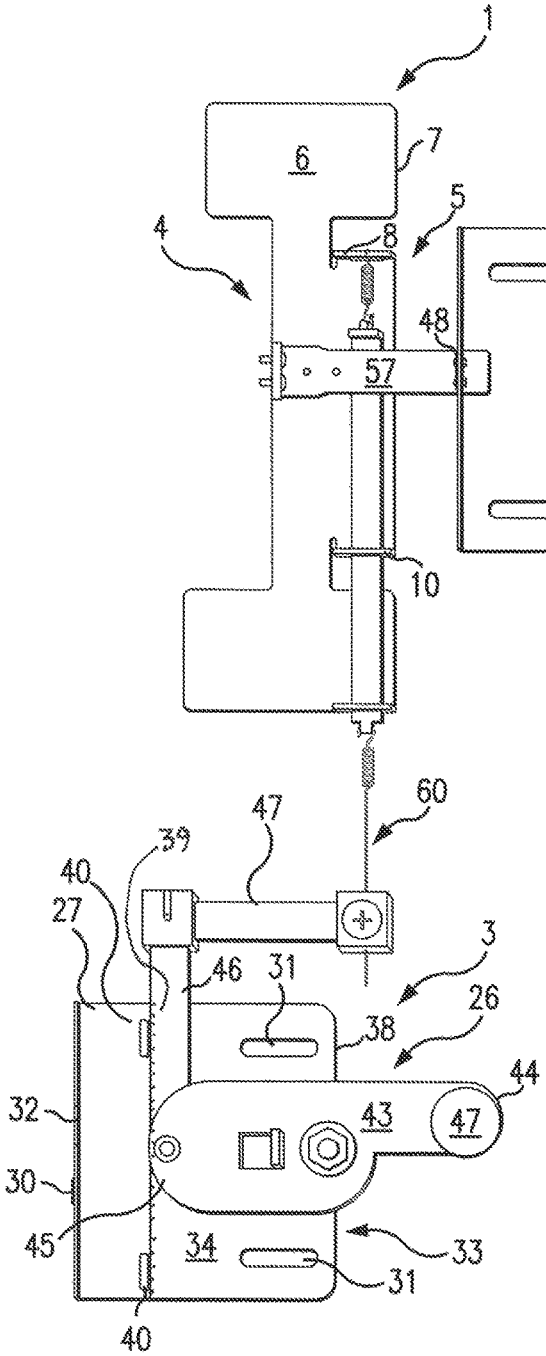
FIG. 1 is an illustration of the defeater assembly of this invention.
Figure 2:
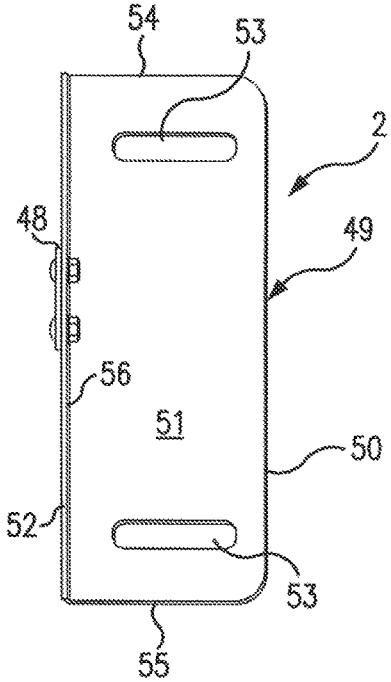
FIG. 2 is a full front view of the defeater hook assembly.

Turning now to FIG. 1, there is shown a full frontal view of a portion of a mechanical cable operated defeater assembly 1, showing a defeater hook assembly unit 2, a disconnect assembly unit 3, and a top rod assembly unit 4.

Figure 4:
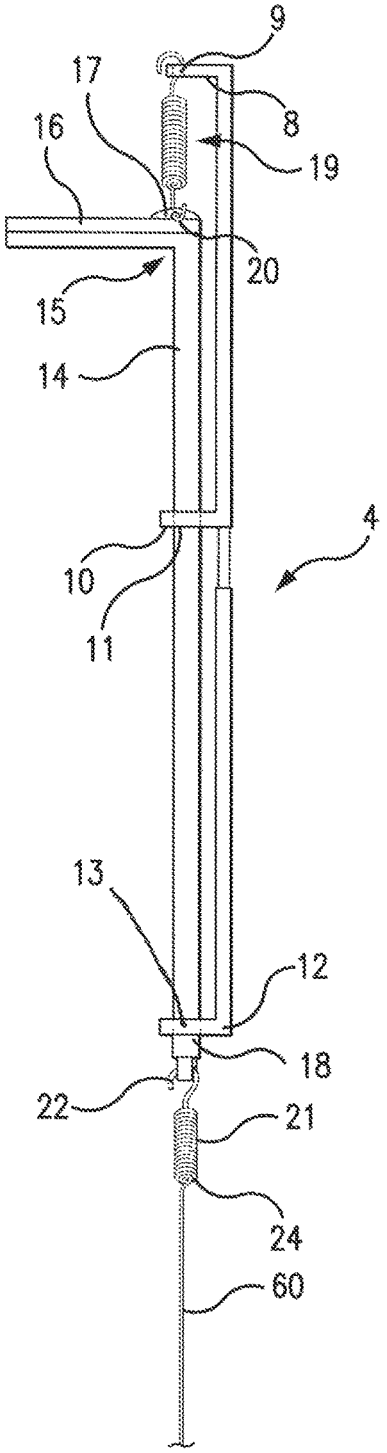
FIG. 4 is a full side view of the top rod cable assembly.
Figure 5:
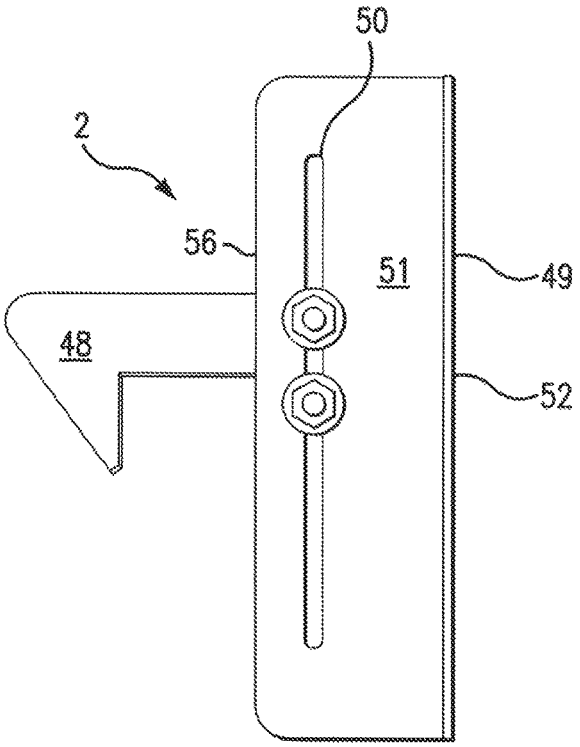
FIG. 5 is a full side view of the defeater hook assembly.

As is shown in FIG. 1, the top rod assembly unit 4 is operably connected to the disconnect assembly unit 3 by a cable 60. The top rod assembly unit 4 is composed of a first rod guide 5, wherein the first rod guide 5 is a flat plate 6 having a first edge 7. The first edge 7 contains a top perpendicular tab 8 with a centered opening 9 (FIG. 4 in phantom), a middle perpendicular table 10, with a centered opening 11, and a bottom perpendicular tab 12 with a centered opening 13.

There is a top rod 14, the top rod 14 comprising a first L-shape 15, with a foot 16, of the first L-shape 15, located perpendicular to the flat plate 6. The top rod 14 has a top end 17 and a bottom end 18.

There is a top extension spring 19. The top extension spring 19 is attached by a first end 20 to the top of the top rod 17. The opposite end of the top extension spring 19 is releasably attached to the top perpendicular tab 8.

There is a bottom extension spring 21, the bottom extension spring 21 is attached to the bottom of the top rod 17 by a first end 22 and the bottom extension spring is attached to a cable 23 at a second end 24. The opposite end of the cable 23 is attached to a top arm 25 of a cam lever assembly 26.

Figure 3:
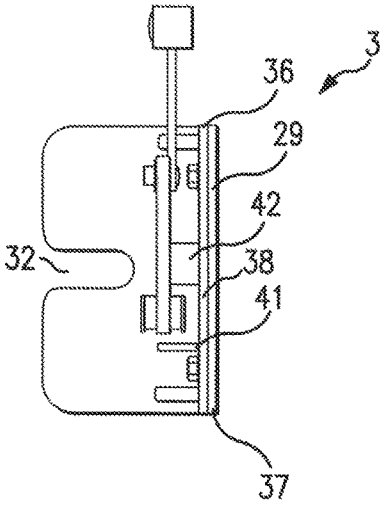
FIG. 3 is a full end view of the disconnect assembly.

The cam lever assembly 26 comprises a base mounting bracket 27 that has a second L-shaped flat plate 28 having a first edge 29 and a second edge 30, wherein the first edge 29 has two openings 31 through them for insertion of machine screws (FIG. 3) and the second edge 30 has a middle slot 32 in it.

There is an adjustable mounting bracket 33 comprising a flat plate 34. The flat plate 34 is mounted on the base mounting bracket 27. The mounting bracket has a top edge 36 and a bottom edge 37, a first side edge 38 and a second side edge 39. The adjustable mounting bracket 33 has two slotted openings 40 in the second side edge 39. A stop plate 41 is centered in the flat plate 34 and a mounting post 42 projects perpendicular to the adjustable mounting bracket 33 near the second side edge 39.

There is rotatably mounted on the mounting post 42, a cam lever 43. The cam lever 43 has a first end 44 and a second end 45. There is a pivot arm 46 rotatably mounted on the second end 45 and the first end has a defeater striker 47 integrally mounted on it.

There is an adjustable hook 48, the adjustable hook 48 having an adjustable hook mounting bracket 49. The adjustable mounting bracket is a second L-shaped flat plate having a first panel 51 and a second panel 52. The first panel has at least two separated, elongated slots 53 near a top edge 54 and near a bottom edge 55. The adjustable mounting bracket 49 has an elongated slot 50 near an edge 56 of said second panel 52. Finally, there is a defeater 57.

Figure 6:
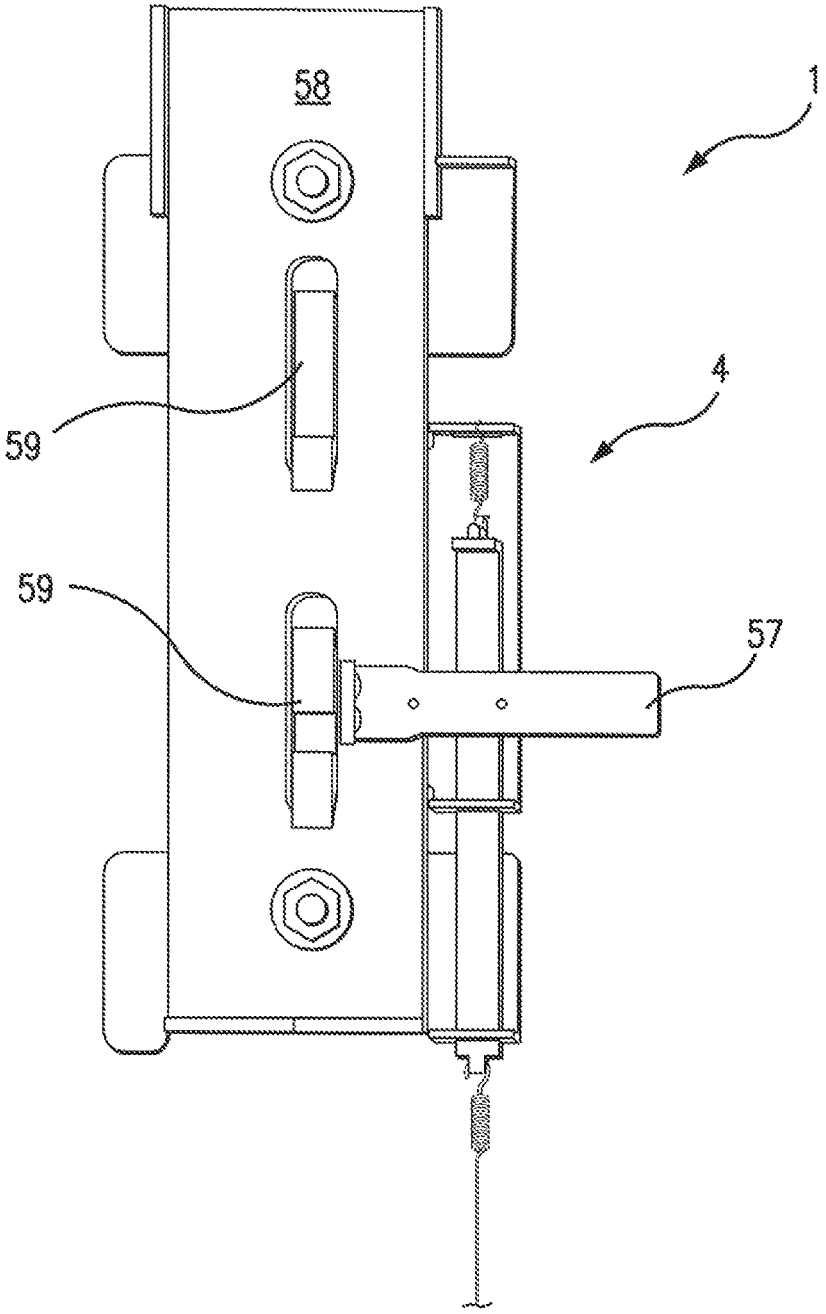
FIG. 6 is a full front view of the top rod cable assembly assembled between an enclosure flange and a disconnect mounting plate, along with latches from the door opening assembly.

FIG. 6 shows a full front view of a portion of an installed device 1 of this invention. What is shown are the rod assembly 4 and a cover plate 58 that are not part of the invention. The cover plate 58 is an inside securing cover plate for the door handle (not shown) and what is illustrated are the latches 59 for such a door handle. The latches 59 are also not part of this invention. Secured to one of the latches 59 is a defeater 57.

What is claimed is:

1. A cable operated mechanical defeater, said cable operated mechanical defeater comprising in combination:

A. a rod assembly, said rod assembly comprising:

a. a first rod guide, said rod guide comprising a first flat plate having a first edge, said first edge containing a top perpendicular tab with a centered opening, a middle perpendicular tab with a centered opening, and a bottom perpendicular tab with a centered opening;

b. a top rod, said top rod comprising a first L-shape, with a foot of said first L-shape perpendicular to said first flat plate said top rod having a top end and a bottom end;

c. a top extension spring, said top extension spring being attached by a first end to said top of said top rod, an opposite end of said top extension spring being releasably attached to said top perpendicular tab;

d. a bottom extension spring, said bottom extension spring being attached to said bottom of said top rod by a first end and said bottom extension spring being attached to a cable at a second end, a first end of said cable being attached to a top arm of a cam lever assembly;

B. said cam lever assembly comprising a. a base mounting bracket comprising a second L-shaped flat plate having a first edge and a second edge, said first edge having two openings therethrough for insertion of machine screws and said second edge having a middle slot therein;

b. an adjustable mounting bracket comprising a moveable first flat plate, said first flat plate mounted on said base mounting bracket by bolts, said base mounting bracket having a top edge and a bottom edge, a first side edge and a second side edge, said adjustable mounting bracket having two perpendicular tabs at said first side edge, and at least two slotted openings in said second side edge, a stop plate centered in said first flat plate, and a mounting post projecting perpendicular to said adjustable mounting bracket, near said second side edge;

c. rotatably mounted on said mounting post, a cam lever, said cam lever having a first end and a second end, there being a pivot arm rotatably mounted on said second end, said cam lever first end having a defeater striker integrally mounted thereon;

C. an adjustable hook, said adjustable hook having a. an adjustable hook mounting bracket, said adjustable hook mounting bracket being a third L-shaped flat plate having a first panel and a second panel, said first panel having at least two separated, elongated slots near a top edge and near a bottom edge, and said adjustable hook mounting bracket having an elongated slot near an edge of said second panel, b. a disconnect hook, said disconnect hook being mounted on the L of said second L-shaped plate;

c. a defeater, said defeater attachable to a latch of a disconnect operating handle.

* * * * *